US011784466B2

(12) United States Patent
Woo et al.

(10) Patent No.: US 11,784,466 B2
(45) Date of Patent: Oct. 10, 2023

(54) MULTI-IGNITION COIL CONTROL SYSTEM

(71) Applicants: HYUNDAI MOTOR COMPANY, Seoul (KR); KIA CORPORATION, Seoul (KR)

(72) Inventors: Soo Hyung Woo, Seoul (KR); Kiseon Sim, Suwon-si (KR); Won Gyu Kim, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/838,563

(22) Filed: Jun. 13, 2022

(65) Prior Publication Data

US 2023/0070763 A1 Mar. 9, 2023

(30) Foreign Application Priority Data

Sep. 9, 2021 (KR) ..... 10-2021-0120289

(51) Int. Cl.
*H01T 13/46* (2006.01)
*H01F 38/12* (2006.01)
(Continued)

(52) U.S. Cl.
CPC ..... *H01T 13/467* (2013.01); *F02P 3/04* (2013.01); *F02P 3/05* (2013.01); *F02P 5/15* (2013.01);
(Continued)

(58) Field of Classification Search
None
See application file for complete search history.

(56) References Cited

U.S. PATENT DOCUMENTS 1,335,797 A * 4/1920 Rohde ..... H01T 13/22 313/236
4,004,562 A * 1/1977 Rado ..... H01T 13/462 313/142
(Continued)

FOREIGN PATENT DOCUMENTS

CA 2818547 A1 * 8/2013 ..... F02D 35/021
CA 2850790 A1 * 8/2013 ..... F02D 35/021
(Continued)

*Primary Examiner* — Kevin R Steckbauer
(74) *Attorney, Agent, or Firm* — MCDONNELL BOEHNEN HULBERT & BERGHOFF LLP

(57) ABSTRACT

A multi-ignition coil control system includes a spark plug including first and second center electrodes, and first and second ground electrodes spaced apart from the center electrodes by a predetermined distance, a first ignition coil including a primary coil, and a secondary coil in which a discharge current is generated by electromagnetic induction with the primary coil, and a second ignition coil including a primary coil, and a secondary coil in which a discharge current is generated by electromagnetic induction with the primary coil, wherein one end of the secondary coil of the first ignition coil and one end of the secondary coil of the second ignition coil are electrically connected to one of the center electrodes, and the other end of the secondary coil of the first ignition coil and the other end of the secondary coil of the second ignition coil are electrically connected to the other of the center electrodes.

8 Claims, 5 Drawing Sheets

(51) Int. Cl.

| | |
|---|---|
| ***F02P 3/05*** | (2006.01) |
| ***F02P 5/15*** | (2006.01) |
| ***F02P 15/08*** | (2006.01) |
| ***F02P 15/10*** | (2006.01) |
| ***F02P 3/04*** | (2006.01) |
| ***H01T 13/22*** | (2006.01) |

(52) U.S. Cl.
CPC ..... *F02P 15/08* (2013.01); *F02P 15/10* (2013.01); *H01F 38/12* (2013.01); *H01T 13/22* (2013.01)

(56) References Cited

U.S. PATENT DOCUMENTS

| | | | | | |
|---|---|---|---|---|---|
| 4,308,487 | A * | 12/1981 | Feaster | H01T 13/22 | 315/71 |
| 5,503,132 | A * | 4/1996 | Miyata | F02P 17/12 | 324/399 |
| 5,918,571 | A * | 7/1999 | Below | H01T 13/467 | 313/144 |
| 9,441,604 | B2 * | 9/2016 | Zheng | F02D 35/021 | |
| 9,742,160 | B1 * | 8/2017 | Minami | F02P 15/08 | |
| 9,828,967 | B2 * | 11/2017 | Zheng | H01T 21/02 | |
| 10,054,099 | B2 * | 8/2018 | Zheng | F02P 9/002 | |
| 10,995,672 | B2 * | 5/2021 | Ramamurthi | F02C 7/266 | |
| 11,251,588 | B1 * | 2/2022 | Woo | H01T 13/467 | |
| 11,509,120 | B2 * | 11/2022 | Woo | H01T 13/41 | |
| 11,545,816 | B2 * | 1/2023 | Niessner | H01T 13/22 | |
| 2009/0107457 | A1 * | 4/2009 | Meyer | F02P 15/04 | 123/310 |
| 2014/0076295 | A1 * | 3/2014 | Zheng | F02P 7/10 | 123/621 |
| 2016/0356258 | A1 * | 12/2016 | Zheng | H01T 13/46 | |
| 2017/0229844 | A1 * | 8/2017 | Minami | H01T 13/24 | |
| 2017/0254312 | A1 * | 9/2017 | Zheng | F02P 3/0442 | |
| 2020/0235552 | A1 * | 7/2020 | Fuchs | H01T 13/50 | |
| 2021/0399531 | A1 * | 12/2021 | Woo | H01T 13/22 | |
| 2022/0213858 | A1 * | 7/2022 | Miyake | F02P 5/1502 | |
| 2023/0029000 | A1 * | 1/2023 | Sim | G01R 19/16533 | |
| 2023/0055431 | A1 * | 2/2023 | Sim | H01T 13/32 | |
| 2023/0070763 | A1 * | 3/2023 | Woo | H01T 13/467 | |

FOREIGN PATENT DOCUMENTS

| | | | | | |
|---|---|---|---|---|---|
| CA | 2818547 | C | * | 8/2014 | F02D 35/021 |
| CA | 2850790 | C | * | 8/2015 | F02D 35/021 |
| CA | 2901240 | A1 | * | 6/2016 | F02M 25/07 |
| CA | 2901240 | C | * | 8/2017 | F02M 25/07 |
| CN | 103527380 | A | * | 1/2014 | F02D 35/021 |
| CN | 203515920 | U | * | 4/2014 | F02D 35/021 |
| CN | 103527380 | B | * | 8/2016 | F02D 35/021 |
| CN | 107046230 | A | * | 8/2017 | F02P 13/00 |
| CN | 107046231 | A | * | 8/2017 | F02P 13/00 |
| CN | 107046230 | B | * | 10/2019 | F02P 13/00 |
| CN | 107046231 | B | * | 9/2020 | F02P 13/00 |
| DE | 3421023 | A | * | 12/1985 | H01T 13/22 |
| DE | 102020134429 | A1 | * | 12/2021 | H01T 13/22 |
| DE | 102021122114 | A1 | * | 6/2022 | H01T 13/22 |
| DE | 112020004624 | T5 | * | 6/2022 | F02P 3/051 |
| EP | 3206269 | A1 | * | 8/2017 | F02P 13/00 |
| EP | 3206270 | A1 | * | 8/2017 | F02P 13/00 |
| EP | 3206269 | B1 | * | 9/2019 | F02P 13/00 |
| EP | 3206270 | B1 | * | 10/2019 | F02P 13/00 |
| EP | 3985813 | A1 | * | 4/2022 | |
| FR | 3115073 | A1 | * | 4/2022 | |
| GB | 2007760 | A | * | 5/1979 | H01T 13/22 |
| JP | 3277079 | B2 | * | 4/2002 | F02P 15/08 |
| JP | 6007344 | B1 | * | 10/2016 | F02P 13/00 |
| JP | 2021050673 | A | * | 4/2021 | F02P 3/051 |
| WO | WO-2017073760 | A1 | * | 5/2017 | F02P 13/00 |
| WO | WO-2021059761 | A1 | * | 4/2021 | F02P 3/051 |

* cited by examiner

MULTI-IGNITION COIL CONTROL SYSTEM

CROSS REFERENCE TO RELATED APPLICATIONS

This application claims priority to and the benefit of Korean Patent Application No. 10-2021-0120289 filed in the Korean Intellectual Property Office on Sep. 9, 2021, the entire contents of which are incorporated herein by reference.

BACKGROUND

(a) Field

The present disclosure relates to a multi-ignition coil control system, and more particularly, to a multi-ignition coil control system that may perform continuous multi-stage ignition.

(b) Description of the Related Art

In gasoline vehicles, a mixture of air and fuel is ignited by a spark generated by a spark plug to be combusted. That is, the air-fuel mixture injected into a combustion chamber during a compression stroke is ignited by a discharge phenomenon of the spark plug, and thus energy required for vehicle's driving is generated while undergoing a high temperature and high pressure expansion process.

The spark plug provided in the gasoline vehicle serves to ignite a compressed air-fuel mixture by spark discharge caused by a high voltage current generated by an ignition coil.

In a spark plug mounted on a conventional gasoline vehicle, spark discharge is generated between a pair of electrodes (a center electrode and a ground electrode) by a high voltage current induced from an ignition coil, and an air-fuel mixture introduced into a combustion chamber is ignited.

A general gasoline engine is mainly operated to combust at a stoichiometric air/fuel ratio (14.7:1, $\lambda=1$).

However, in a case of an engine for realizing lean burn combustion, the air-fuel ratio is about 30:1 ($\lambda=2$). In this case, since the fuel injected into the air-fuel mixture in the combustion chamber is very small compared with an amount of air thereof, there is a problem that the air-fuel mixture is not ignited (misfired) or incomplete combustion occurs even if spark discharge occurs by the spark plug.

The above information disclosed in this Background section is only for enhancement of understanding of the background of the disclosure, and therefore it may contain information that does not form the prior art that is already known in this country to a person of ordinary skill in the art.

SUMMARY

The present disclosure has been made in an effort to provide a multi-ignition coil control system that may perform continuous multi-stage ignition by using a minimum number of ignition coils.

An embodiment of the present disclosure provides a multi-ignition coil control system, including a spark plug that includes a pair of center electrodes including a first center electrode and a second center electrode, and a pair of ground electrodes including a first ground electrode and a second ground electrode disposed to be respectively spaced apart from the pair of center electrodes by a predetermined distance, a first ignition coil that includes a primary coil, and a secondary coil in which a discharge current is generated by electromagnetic induction with the primary coil, and a second ignition coil that includes a primary coil, and a secondary coil in which a discharge current is generated by electromagnetic induction with the primary coil, wherein one end of the secondary coil of the first ignition coil and one end of the secondary coil of the second ignition coil are electrically connected to one of the pair of center electrodes, and the other end of the secondary coil of the first ignition coil and the other end of the secondary coil of the second ignition coil are electrically connected to the other of the pair of center electrodes.

Spark discharges may be alternately and continuously generated between the first center electrode and the first ground electrode and between the second center electrode and the second ground electrode.

The multi-ignition coil control system may further include a battery electrically connected to one end of the primary coil, a first switch electrically connected to the other end of the primary coil of the first ignition coil to selectively block a current applied to the primary coil, and a second switch electrically connected to the other end of the primary coil of the second ignition coil to selectively block a current applied to the primary coil.

The multi-ignition coil control system may further include an ignition controller that turns the first switch and the second switch on or off to control charging and discharging of the first ignition coil and the second ignition coil.

A first control signal may be applied to the first switch from the ignition controller, a second control signal may be applied to the second switch, and the first control signal and the second control signal may be delayed for a set delay time.

A period of the first control signal and a period of the second control signal may be set to be the same.

A diode may be installed between one end of the secondary coil and one of the pair of center electrodes so that a current may flow from the secondary coil to only one of the pair of center electrodes.

A diode may be installed between the other end of the secondary coil and the other of the pair of center electrodes so that a current may flow from the secondary coil to only the other of the pair of center electrodes.

According to the multi-ignition coil control system of the embodiment of the present disclosure as described above, it is possible to perform continuous multi-stage ignition of a spark plug including two center electrodes by using a minimum number of ignition coils.

BRIEF DESCRIPTION OF THE FIGURES

These drawings are for reference only in describing embodiments of the present disclosure, and therefore, the technical idea of the present disclosure should not be limited to the accompanying drawings.

DETAILED DESCRIPTION

Figure 1:
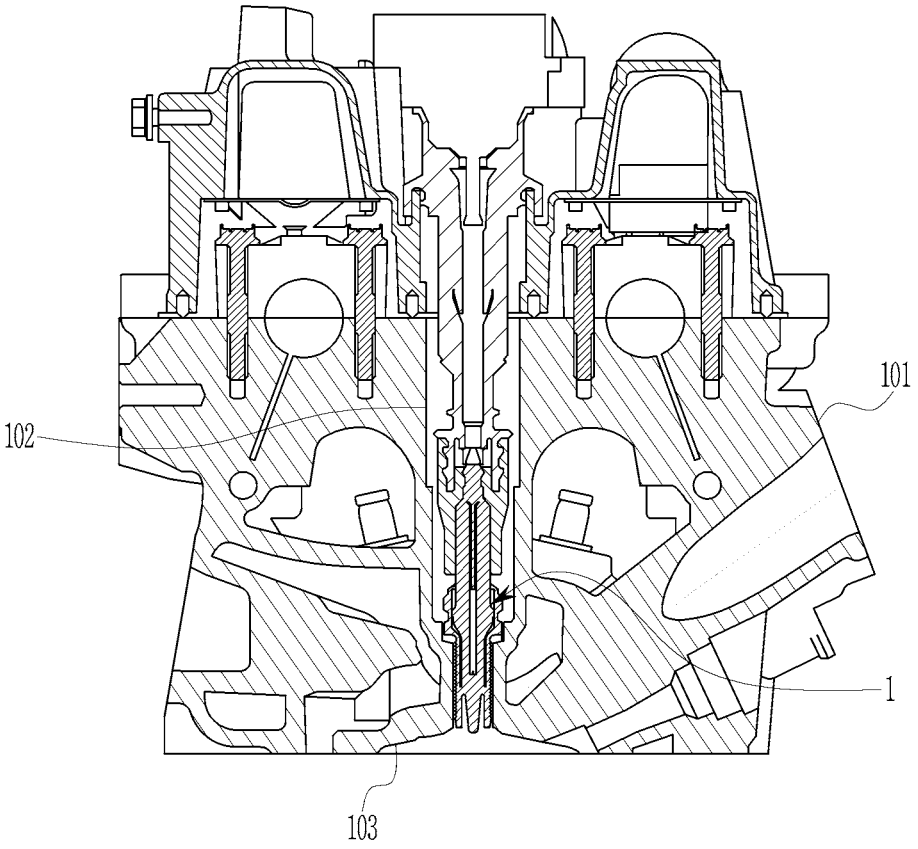
FIG. 1 illustrates a cross-sectional view of an engine in which a spark plug is mounted according to an embodiment of the present disclosure.

The present disclosure will be described more fully hereinafter with reference to the accompanying drawings, in which embodiments of the disclosure are shown. As those skilled in the art would realize, the described embodiments may be modified in various different ways, all without departing from the spirit or scope of the present disclosure.

In order to clearly describe the present disclosure, parts that are irrelevant to the description are omitted, and identical or similar constituent elements throughout the specification are denoted by the same reference numerals.

In addition, since the size and thickness of each configuration shown in the drawings are arbitrarily shown for convenience of description, the present disclosure is not necessarily limited to configurations illustrated in the drawings, and in order to clearly illustrate several parts and areas, enlarged thicknesses are shown.

Hereinafter, a multi-ignition coil control system according to an embodiment of the present disclosure will be described in detail with reference to the accompanying drawings.

FIG. 1 illustrates a cross-sectional view of an engine in which a spark plug is mounted according to an embodiment of the present disclosure.

As shown in FIG. 1, a spark plug 1 according to an embodiment of the present disclosure is mounted on a cylinder of an engine, and generates spark discharge.

The engine to which the spark plug 1 is applied includes a cylinder block and a cylinder head 101, and the cylinder block and the cylinder head 101 are combined to form a combustion chamber 103 therein. An air-fuel mixture inflowing into the combustion chamber 103 is ignited by spark discharge generated by the spark plug 1.

In the cylinder head 101, a mount hole 102 in which the spark plug 1 is mounted is formed long in a vertical direction. A lower portion of the spark plug 1 that is mounted in the mount hole 102 protrudes into the combustion chamber 103. A center electrode and a ground electrode that are electrically connected to an ignition coil are formed at the lower portion of the spark plug 1, and the spark discharge is generated between the center electrode and the ground electrode.

Figure 2:
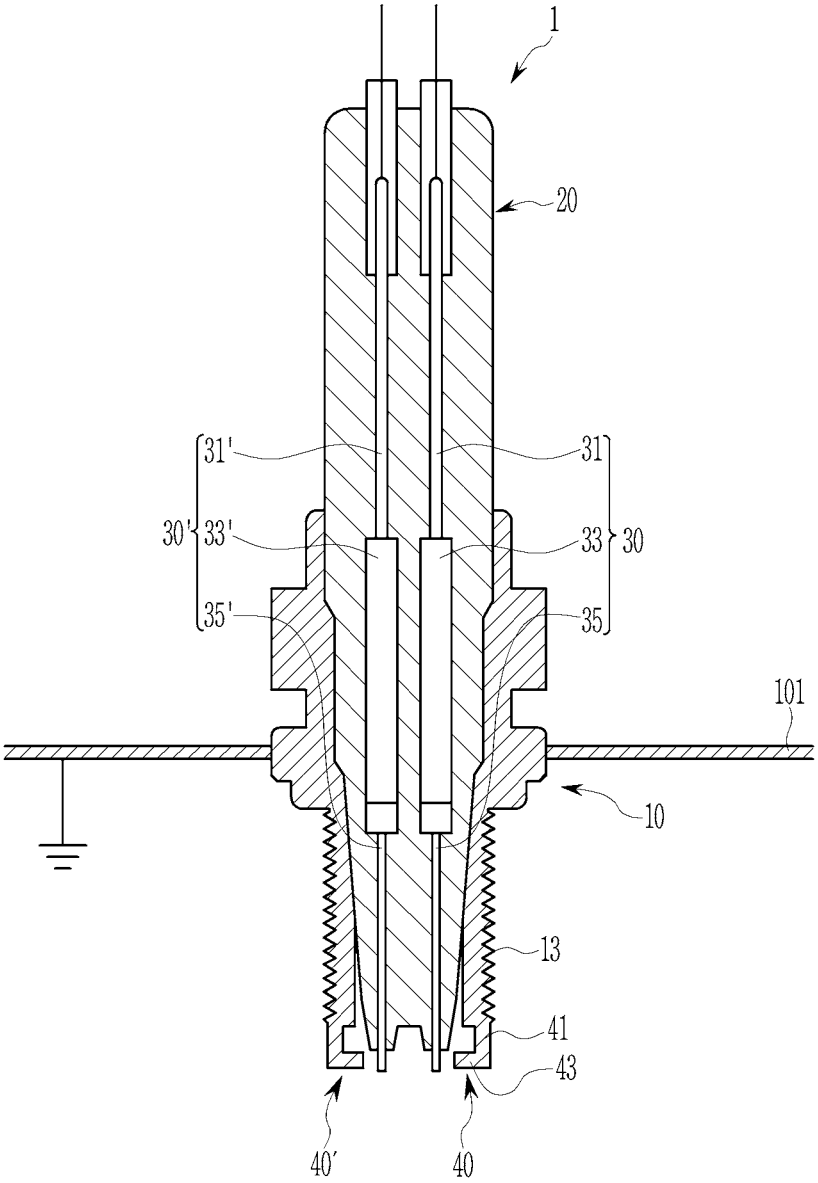
FIG. 2 illustrates a cross-sectional view of a spark plug according to an embodiment of the present disclosure.

FIG. 2 illustrates a cross-sectional view of a spark plug according to an embodiment of the present disclosure.

As shown in FIG. 2, a spark plug according to an embodiment of the present disclosure may include a metal body 10 made of a metal material, an insulating body 20 made of an insulating material provided inside the metal body 10, a pair of center electrodes 30 and 30' provided inside the insulating body 20 and having different polarities, and a pair of ground electrodes 40 and 40' extending from the metal body 10 and generating a spark discharge between the center electrodes 30 and 30'.

The pair of center electrodes 30 and 30' include a positive electrode 30 and a negative electrode 30'. The positive electrode and the negative electrode are supplied with a high voltage current from two ignition coils 110.

The metal body 10 is a portion mounted on a cylinder head 101 of the engine and is formed in a substantially cylindrical shape, and a threaded portion 13 in which a thread is formed for coupling with the cylinder head 101 is formed on a lower outer side of the metal body 10. Another thread corresponding to the thread of the metal body 10 is formed in the cylinder head 101 of the engine. That is, the dual spark plug and the cylinder head 101 of the engine are screwed to each other. The metal body 10 and the cylinder head 101 of the engine are screwed to each other, so that the metal body 10 and the pair of ground electrodes 40 and 40' form a ground terminal.

In the embodiment of the present disclosure, the pair of ground electrodes 40 and 40' forming the ground terminal include a first ground electrode 40 and a second ground electrode 40', and they mean electrodes that maintain a reference potential that is not necessarily 0 V.

Accordingly, a potential of the positive electrode 30 of the center electrode is higher than that of the pair of ground electrodes 40 and 40', and a potential of the negative electrode 30' of the center electrode is lower than that of the ground electrode. Accordingly, one spark discharge is generated by a potential difference between the positive electrode 30 and the pair of ground electrodes 40 and 40', and another spark discharge is generated by a potential difference between the negative electrode 30 and the pair of ground electrodes 40 and 40'.

The insulating body 20 may be made of a ceramic material, and is provided inside the metal body 10. The insulating body 20 may prevent a pair of metal materials from being electrically short-circuited to each other.

The pair of center electrodes 30 and 30' are provided inside the insulating body 20, and may be disposed to be spaced apart from each other by a predetermined distance. For example, the pair of center electrodes may be disposed to be spaced apart from each other by a set distance from a center of a lower portion of the insulating body.

The pair of center electrodes 30 and 30' includes a first center electrode 30 and a second center electrode 30', and the center electrodes 30 and 30' have terminal portions 31 and 31', noise filter portions 33 and 33', and electrode portions 35 and 35', respectively.

The terminal portions 31 and 31' of the central electrodes 30 and 30' are electrically connected to the ignition coil 110. In this case, the terminal portions 31 and 31' of the center electrodes 30 and 30' may extend to an upper central portion of the insulating body 20 to be electrically connected to the ignition coil 110.

The noise filter portions 33 and 33' of the center electrodes 30 and 30' are used to remove noise that may be generated when a current (or a voltage) is applied from the ignition coil 110 to the electrode portions 35 and 35' of the center electrodes 30 and 30', and they may be formed to surround the central portion of the metal electrode. The noise filter portions 33 and 33' may be made of a glass material.

The electrode portions 35 and 35' of the center electrodes 30 and 30' are portions in which spark discharge is generated between a pair of ground electrodes 40 and 40'. The central electrodes 30 and 30' may extend downward of the insulating body 20.

The pair of central electrodes 30 and 30 are disposed to be spaced apart from each other by a set distance from a center of a lower portion of the insulating body 20.

The pair of ground electrodes 40 and 40' are bent toward the pair of center electrodes 30 and 30' from a lower end of the metal body 10. That is, the pair of ground electrodes 40 and 40' may include ground vertical portions 41 and 41' extending downward from the lower end of the metal body 10, and ground horizontal portions 43 and 43' extending from the ground vertical portions 41 and 41' toward the pair of center electrodes 30 and 30'.

On the other hand, the ignition coil supplies a current to the pair of center electrodes 30 and 30'.

Figure 3:
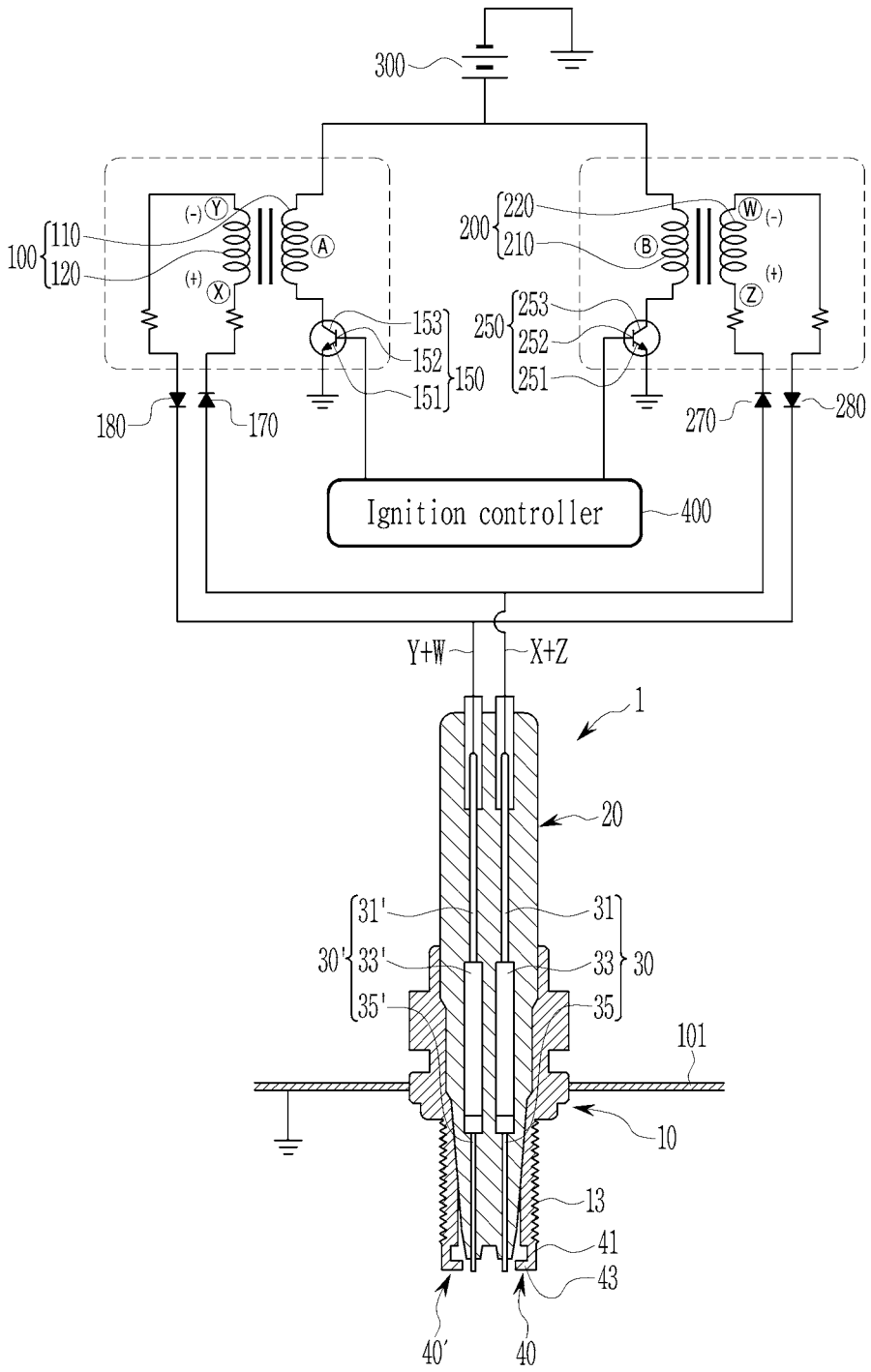
FIG. 3 illustrates a schematic view of a multi-ignition coil control system according to an embodiment of the present disclosure.

Referring to FIG. 3, the ignition coil includes a first ignition coil 100 and a second ignition coil 200.

The first ignition coil 100 includes a primary coil 110 and a secondary coil 120. One end of the primary coil 110 is electrically connected to a battery 300, and the other end thereof is grounded through a first switch 150. According to an on/off operation of the first switch 150, the primary coil 110 of the first ignition coil 110 may be selectively electrically connected.

The first switch 150 may be realized with a transistor switch (for example, an insulated gate bipolar transistor (IGBT)) including an emitter terminal 151, a base terminal 152, and a collector terminal 153. That is, the other end of the primary coil 110 may be electrically connected to the collector terminal 153 of the first switch 150, the emitter terminal 151 thereof may be grounded, and the base terminal 152 thereof may be electrically connected to an ignition controller 400.

One end of the secondary coil 120 is electrically connected to one center electrode 30 (for example, a positive electrode) of the pair of center electrodes 30 and 30', and the other end thereof is electrically connected to the other center electrode 30' (for example, a negative electrode) of the pair of center electrodes 30 and 30'.

In this case, a first diode 170 is installed between one end of the secondary coil 120 and the positive electrode 30 so that a current flows only in a direction from one end of the secondary coil 120 to the positive electrode 30, and a second diode 180 is installed between the other end of the secondary coil 120 and the negative electrode 30' so that a current flows only in a direction from the negative electrode 30' to the other end of the secondary coil 120.

When a control signal is applied to the base terminal 152 of the first switch 150 by the ignition controller 400, the primary coil 110 of the first ignition coil 100 is electrically connected, and electrical energy is charged to the primary coil 110. When no control signal is applied to the base terminal 152 of the first switch 150 by the ignition controller 400, a high voltage current (or discharge current) is generated in the secondary coil 120 due to electromagnetic induction of the primary coil 110 and the secondary coil 120. The discharge current generated in the secondary coil 120 flows to the positive electrode 30 and the negative electrode 30', and while spark discharge is generated between the center electrodes 30 and 30' and the ground electrodes 40 and 40' by the discharge current generated in the secondary coil 120, an air-fuel mixture inside the combustion chamber 103 is ignited.

That is, the ignition controller 400 charges or discharges the first ignition coil 110 by turning the first switch 150 on/off. When the ignition controller 400 applies a control signal to the base terminal 152 of the first switch 150 (or when the switch is turned on), the primary coil 110 is charged (or the first ignition coil is charged).

In addition, when the ignition controller 400 does not apply a control signal to the base terminal 152 of the first switch 150 (or when the first switch is turned off), a high voltage current is generated in the secondary coil 120 due to electromagnetic induction with the primary coil 110, and spark discharge is generated between the center electrodes 30 and 30' and the ground electrodes 40 and 40' (or the first ignition coil is discharged) by the high voltage current generated in the secondary coil 120.

Like the first ignition coil 100, the second ignition coil 200 includes a primary coil 210 and a secondary coil 220. One end of the primary coil 210 is electrically connected to a battery 300, and the other end thereof is grounded through a second switch 250. According to an on/off operation of the second switch 250, the primary coil 210 of the second ignition coil 210 may be selectively electrically connected.

The second switch 250 may be realized with a transistor switch (for example, an insulated gate bipolar transistor (IGBT)) including an emitter terminal 251, a base terminal 252, and a collector terminal 253. That is, the other end of the primary coil 210 may be electrically connected to the collector terminal 253 of the second switch 250, the emitter terminal 251 thereof may be grounded, and the base terminal 252 thereof may be electrically connected to the ignition controller 400.

One end of the secondary coil 220 is electrically connected to one center electrode 30 (for example, a positive electrode) of the pair of center electrodes 30 and 30', and the other end thereof is electrically connected to the other center electrode 30' (for example, a negative electrode) of the pair of center electrodes 30 and 30'.

In this case, a first diode 270 is installed between one end of the secondary coil 220 and the positive electrode 30 so that a current flows only in a direction from one end of the secondary coil 220 to the positive electrode 30, and a second diode 280 is installed between the other end of the secondary coil 220 and the negative electrode 30' so that a current flows only in a direction from the negative electrode 30' to the other end of the secondary coil 220.

When a control signal is applied to the base terminal 252 of the second switch 250 by the ignition controller 400, the primary coil 210 of the second ignition coil 200 is electrically connected, and electrical energy is charged to the primary coil 210. When no control signal is applied to the base terminal 252 of the second switch 250 by the ignition controller 400, a high voltage current (or discharge current) is generated in the secondary coil 220 due to electromagnetic induction of the primary coil 210 and the secondary coil 220. The discharge current generated in the secondary coil 220 flows to the positive electrode 30 and the negative electrode 30', and while spark discharge is generated between the center electrodes 30 and 30' and the ground electrodes 40 and 40' by the discharge current generated in the secondary coil 220, an air-fuel mixture inside the combustion chamber 103 is ignited.

That is, the ignition controller 400 charges or discharges the second ignition coil 210 by turning the second switch 250 on/off. When the ignition controller 400 applies a control signal to the base terminal 252 of the second switch 250 (or when the switch is turned on), the primary coil 210 is charged (or the second ignition coil is charged).

In addition, when the ignition controller 400 does not apply a control signal to the base terminal 252 of the second switch 250 (or when the second switch is turned off), a high voltage current is generated in the secondary coil 220 due to electromagnetic induction with the primary coil 210, and spark discharge is generated between the center electrodes 30 and 30' and the ground electrodes 40 and 40' (or the second ignition coil is discharged) by the high voltage current generated in the secondary coil 220.

In the specification of the present disclosure, charging the primary coil of the first ignition coil 100 by turning on the first switch 150 is described as charging the first ignition coil 100, and a high voltage current is induced to the secondary coil of the first ignition coil 100 by turning off the first switch 150 and thus spark discharge occurs between the center electrodes 30 and 30' and the ground electrodes 40 and 40' is described as the first ignition coil 100 being discharged.

Likewise, charging the primary coil of the second ignition coil 200 by turning on the second switch 250 is described as charging the second ignition coil 200, and a high voltage current that is induced to the secondary coil of the second ignition coil 200 by turning off the second switch 250 and thus spark discharge occurs between the center electrodes 30 and 30' and the ground electrodes 40 and 40' is described as the second ignition coil 200 being discharged.

The multi-ignition coil control system according to the embodiment of the present disclosure controls the charging and discharging of two ignition coils based on a control signal transmitted from the ignition controller, so that the continuous spark discharge may be generated between the pair of center electrodes 30 and 30' and the pair of ground electrodes 40 and 40'.

That is, in the multi-ignition coil control system according to the embodiment of the present disclosure, the spark discharge is alternately and continuously generated between the positive electrode 30 and the ground electrode 30 and between the negative electrode 30' and the ground electrode 40'.

In other words, the spark discharge is generated between the positive electrode 30 of the pair of center electrodes 30 and 30' and the ground electrode 40, and then is generated between the negative electrode 30' thereof and the ground electrode 40', so that the spark discharge is alternately generated between the positive electrode 30 and the ground electrode 30 and between the negative electrode 30' and the ground electrode 40', and accordingly, the continuous spark discharge may be realized.

To this end, the ignition controller may be provided as at least one processor executed by a predetermined program, and the predetermined program is configured to perform respective steps of an ignition coil control method according to an embodiment of the present disclosure.

Hereinafter, the operation of the multi-ignition coil control system according to the embodiment of the present disclosure as described above will be described in detail with reference to the accompanying drawings.

Figure 4:
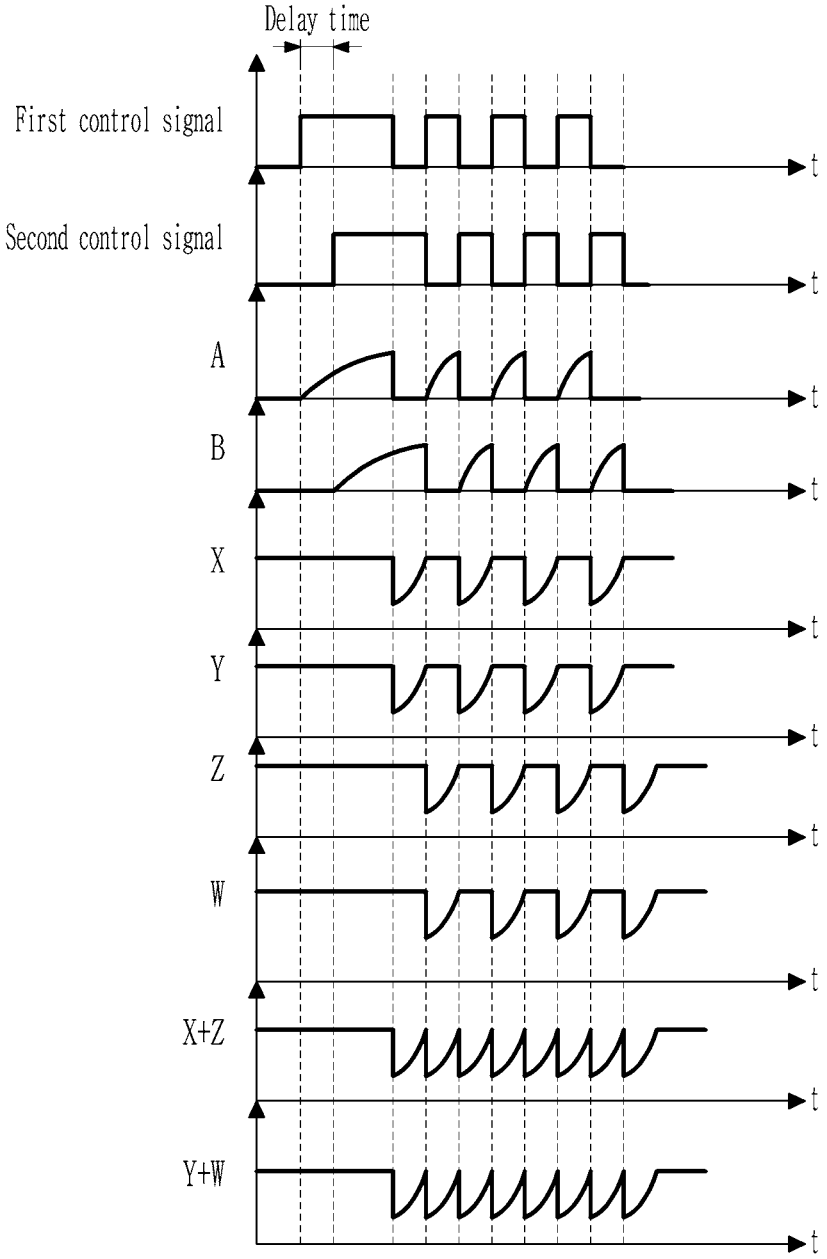
FIG. 4 illustrates a graph measuring currents of a primary coil and a secondary coil according to an embodiment of the present disclosure.

FIG. 4 illustrates graphs for explaining an operation of a multi-ignition coil control system according to an embodiment of the present disclosure.

In the graphs shown in FIG. 4, a signal (A) is a current of the primary coil 110 of the first ignition coil 100. A signal (B) is a current of the primary coil 210 of the second ignition coil 200. A signal (X) is a current flowing from one end of the secondary coil 120 of the first ignition coil 100 to the positive electrode 30 and the ground electrode 40 of the spark plug 1. A signal (Y) is a current flowing from the other end of the secondary coil 120 of the first ignition coil 100 to the negative electrode 30' and the ground electrode 40' of the spark plug 1. A signal (Z) is a current flowing from one end of the secondary coil 220 of the second ignition coil 200 to the positive electrode 30 and the ground electrode 40 of the spark plug 1. A signal (W) is a current flowing from the other end of the secondary coil 220 of the second ignition coil 200 to the negative electrode 30' and the ground electrode 40' of the spark plug 1.

In addition, in the graph shown in FIG. 4, a signal (X+Z) is a signal obtained by adding the signal (X) and the signal (Y), and a signal (Y+W) is a signal obtained by adding the signal (Y) and the signal (W). That is, the signal (X+Z) represents a current discharged between the positive electrode 30 of the center electrode and the ground electrode 40, and the signal (Y+W) represents a current discharged between the negative electrode 30' of the center electrode and the ground electrode 40'.

That is, the signal (X+Z) means a current applied between the positive electrode 30 and the ground electrode 40, and the signal (Y+W) means a current applied between the negative electrode 30' and the ground electrode 40.

Referring to FIG. 4, the ignition controller 400 applies a first control signal to the first switch 150 of the first ignition coil 100 to ignite the air-fuel mixture introduced into the combustion chamber 103 during the explosion stroke of the engine, and applies a second control signal to the second switch 250 of the second ignition coil 200.

The first control signal and the second control signal are in a form of a plurality of pulses having a set period, and the second control signal is delayed with the first signal for a set delay time.

Periods of first pulses of the first control signal and the second control signal are the longest, and periods of the remaining pulses that follow may be set to be shorter than the period of the first pulse. In this case, the periods of the first pulses of the first control signal and the second control signal may be determined as a time for which the first ignition coil 100 and the second ignition coil 200 are fully charged. In addition, lengths of the remaining pulses following the first pulses of the first control signal and the second control signal may be set shorter than that of the first pulse, and periods thereof may be the same as that of the first pulse.

When the first control signal is turned on, the primary coil 110 of the first ignition coil 100 is charged by an operation of the first switch 150 (see 'A' in FIG. 4), and when the first control signal is turned off, a discharge current is generated in the secondary coil 120 due to electromagnetic induction between the primary coil 110 and the secondary coil 120 of the first ignition coil 100.

The discharge current generated in the secondary coil 120 of the first ignition coil 100 is applied to the center electrodes 30 and 30' and the ground electrodes 40 and 40' of the spark plug 1.

In this case, the discharge current (for example, about 2 kV/200 mA) generated in the secondary coil 120 has a higher potential than the ground electrode 40 at the positive electrode 30 electrically connected to one end of the secondary coil 120 due to electrical characteristics, and has a lower potential than the ground electrode 40' at the negative electrode 30' electrically connected to the other end of the secondary coil 120.

Accordingly, spark discharge is generated between the positive electrode 30 and the ground electrode 40 due to the potential difference between the positive electrode 30 electrically connected to one end of the secondary coil 120 and the ground electrode 40 (see 'X' in FIG. 4), and spark discharge is also generated between the negative electrode 30' and the ground electrode 40' due to the potential difference between the negative electrode 30' electrically connected to the other end of the secondary coil 120 and the ground electrode 40' (see 'Y' in FIG. 4).

That is, by the first control signal applied to the first switch 150 of the first ignition coil 100, spark discharge is simultaneously generated between the pair of center electrodes 30 and 30' and the pair of ground electrodes 40 and 40' of the spark plug 1.

In addition, when the second control signal is turned on, the primary coil 210 of the second ignition coil 200 is charged by an operation of the second switch 250 (see 'B' in FIG. 4), and when the second control signal is turned off, a discharge current is generated in the secondary coil 220 due to electromagnetic induction between the primary coil 210 and the secondary coil 220 of the second ignition coil 200.

The discharge current generated in the secondary coil 220 of the second ignition coil 200 is applied to the center electrodes 30 and 30' and the ground electrodes 40 and 40' of the spark plug 1.

In this case, the discharge current (for example, about 2 kV/200 mA) generated in the secondary coil 220 has a higher potential than the ground electrode 40 at the positive electrode 30 electrically connected to one end of the secondary coil 220 due to electrical characteristics, and has a lower potential than the ground electrode 40' at the negative electrode 30' electrically connected to the other end of the secondary coil 220.

Accordingly, spark discharge is generated between the positive electrode 30 and the ground electrode 40 due to the potential difference between the positive electrode 30 electrically connected to one end of the secondary coil 220 and the ground electrode 40 (see 'Z' in FIG. 4), and spark discharge is also generated between the negative electrode 30' and the ground electrode 40' due to the potential difference between the negative electrode 30' electrically connected to the other end of the secondary coil 220 and the ground electrode 40' (see 'W' in FIG. 4).

That is, by the second control signal applied to the second switch 250 of the second ignition coil 200, spark discharge is simultaneously generated between the pair of center electrodes 30 and 30' and the pair of ground electrodes 40 and 40' of the spark plug 1.

Meanwhile, the second control signal is delayed for a set delay time with the first control signal, and periods of the first control signal and the second control signal are the same.

Accordingly, the spark discharge between the positive electrode 30 electrically connected to one end of the secondary coil 120 of the first ignition coil 100 and the ground electrode 40 and the spark discharge between the positive electrode 30 electrically connected to one end of the secondary coil 220 of the second ignition coil 200 and the ground electrode 40 are continuously generated (see 'X+Z' in FIG. 4).

In addition, the spark discharge between the negative electrode 30' electrically connected to the other end of the secondary coil 120 of the first ignition coil 100 and the ground electrode 40' and the spark discharge between the negative electrode 30' electrically connected to the other end of the secondary coil 220 of the second ignition coil 200 and the ground electrode 40' are continuously generated (see 'Y+W' in FIG. 4).

As described above, since the continuous multi-stage ignition is realized between the pair of center electrodes 30 and 30' and the pair of ground electrodes 40 and 40', an initial combustion rate is increased and knocking is prevented from occurring, so that the engine output and fuel efficiency may be improved.

In addition, even when the ignition property of the air-fuel mixture is degraded, such as when EGR gas is supplied to the combustion chamber 103 of the engine or lean combustion occurs, sufficient ignition energy may be supplied into the combustion chamber 103.

Figures 5A, 5B, 5C, 5D:
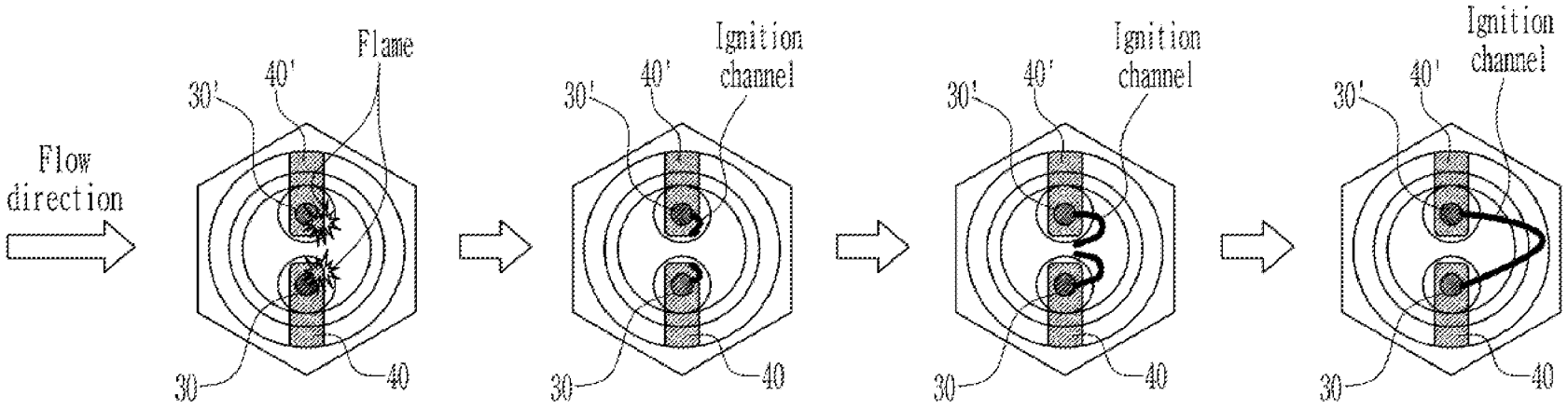
FIGS. 5A, 5B, 5C, and 5D illustrate an operation of a spark plug according to an embodiment of the present disclosure.

Meanwhile, referring to FIG. 5, when a current is applied from the secondary coil 112 of the ignition coil 110 to the positive electrode 30 and the negative electrode 30' of the center electrodes 30 and 30', the spark discharge is generated between the positive electrode 30 and the ground electrode 40 and between the negative electrode 30' and ground electrode 40' (see FIG. 5A).

In this case, since the potential of the ground electrode 40 is higher than that of the positive electrode 30, a current flows from the positive electrode 30 to the ground electrode 40, and one spark discharge is generated. In addition, since the potential of the ground electrode 40 is higher than that of the negative electrode 30', a current flows from the ground electrode 40 to the negative electrode 30', and another spark discharge is generated.

By the spark discharge respectively generated between the positive electrode 30 and the ground electrode 40 and between the negative electrode 30' and the ground electrode 40, an ignition channel through which a high voltage current flows is formed between the positive electrode 30 and the ground electrode 40 and between the negative electrode 30' and the ground electrode 40. In an initial stage of ignition, the ignition channel formed between the positive electrode 30 and the ground electrode 40 and between the negative electrode 30' and the ground electrode 40 gradually increases along a flow direction inside the combustion chamber (see FIG. 5B and FIG. 5C). Here, the ignition channel means an electrical channel through which a current flows between the positive electrode 30 and the ground electrode 40 and between the ground electrode 40 and the negative electrode 30'.

Two ignition channels that gradually increase along the flow direction inside the combustion chamber form one ignition channel by electrical attraction over time (see FIG. 5D). In this case, a current flows from the positive electrode to the negative electrode.

Two ignition channels are formed in the initial stage of ignition, and as time passes, the two ignition channels form one ignition channel extended by electrical attraction.

As described above, a relatively large flame nucleus is formed by the one extended ignition channel formed while the two ignition channels are merged by electrical attraction, so that the ignition efficiency may be improved, and the initial combustion rate may be improved. In addition, as the combustion rate is improved, the efficiency of the engine and the output of the engine may be improved, and the emission may be improved.

While this disclosure has been described in connection with what is presently considered to be practical embodiments, it is to be understood that the disclosure is not limited to the disclosed embodiments, but, on the contrary, is intended to cover various modifications and equivalent arrangements included within the spirit and scope of the appended claims.

The invention claimed is:

1. A multi-ignition coil control system, comprising:

a spark plug including a first center electrode and a second center electrode, and a first ground electrode and a second ground electrode, the first and second ground electrodes being p spaced apart from the first and second center electrodes by a predetermined distance;

a first ignition coil including a primary coil and a secondary coil, the secondary coil having a discharge current generated by electromagnetic induction with the primary coil; and a second ignition coil including a primary coil and a secondary coil, the secondary coil having a discharge current generated by electromagnetic induction with the primary coil;

wherein a negative end of the secondary coil of the first ignition coil and a negative end of the secondary coil of the second ignition coil are both directly electrically connected to one of the first and second center electrodes via a first diode; and wherein a positive end of the secondary coil of the first ignition coil and a positive end of the secondary coil of the second ignition coil are both directly electrically connected to an other of the first and second center electrodes via a second diode.

2. The multi-ignition coil control system of claim 1, wherein spark discharges are alternately and continuously generated between the first center electrode and the first ground electrode, and between the second center electrode and the second ground electrode.

3. The multi-ignition coil control system of claim 1, further comprising:

a battery electrically connected to the one end of the primary coil of the first ignition coil;

a first switch electrically connected to the other end of the primary coil of the first ignition coil to block a current applied to the primary coil of the first ignition coil; and a second switch electrically connected to the other end of the primary coil of the second ignition coil to block a current applied to the primary coil of the second ignition coil.

4. The multi-ignition coil control system of claim 3, further comprising an ignition controller configured to turn the first switch and the second switch on or off to control charging and discharging of the first ignition coil and the second ignition coil.

5. The multi-ignition coil control system of claim 4, wherein:

a first control signal is applied to the first switch from the ignition controller;

a second control signal is applied to the second switch; and the first control signal and the second control signal are delayed for a set delay time.

6. The multi-ignition coil control system of claim 5, wherein a period of time of the first control signal and a period of time of the second control signal are set to be the same.

7. The multi-ignition coil control system of claim 1, wherein a first diode is installed between one end of the secondary coil of the first ignition coil and one of the first and second center electrodes so that a current flows from the secondary coil of the first ignition coil to only the first or second center electrode.

8. The multi-ignition coil control system of claim 7, wherein a second diode is installed between the other end of the secondary coil of the first ignition coil and the other of the first and second center electrodes so that a current flows from the secondary coil of the first ignition coil to only the other of the first or second center electrode.

* * * * *